US005232342A

United States Patent [19]

Thompson

[11] Patent Number: 5,232,342

[45] Date of Patent: Aug. 3, 1993

[54] HIGH PRESSURE MULTI-STAGE CENTRIFUGAL PUMPS

[75] Inventor: Peter Thompson, Huddersfield, England

[73] Assignee: David Brown Engineering Limited, West Yorkshire, England

[21] Appl. No.: 976,205

[22] Filed: Nov. 13, 1992

Related U.S. Application Data

[63] Continuation-in-part of Ser. No. 721,384, Jun. 26, 1991, abandoned.

[30] Foreign Application Priority Data

Jul. 7, 1990 [GB] United Kingdom ..... 9015047

[51] Int. Cl.[5] ..... F01D 25/16

[52] U.S. Cl. ..... 415/214.1; 415/199.1; 415/172.1; 277/136; 277/166; 384/295; 384/906

[58] Field of Search ..... 415/199.1, 199.2, 214.1, 415/172.1, 173.1; 277/166, 136; 384/906, 295

[56] References Cited

U.S. PATENT DOCUMENTS

| | | | |
|---|---|---|---|
| 2,085,457 | 6/1937 | Westerhouse | 277/136 |
| 2,465,930 | 3/1949 | Robinson | 415/172.1 |
| 3,265,001 | 8/1966 | Deters | 415/172.1 |
| 3,383,142 | 5/1968 | Scott | 384/295 |
| 3,861,825 | 1/1975 | Blom | 415/214.1 |
| 4,017,127 | 4/1977 | Smith et al. | 384/295 |
| 4,738,548 | 4/1988 | Zloch et al. | 384/99 |
| 4,800,057 | 1/1989 | Rabe | 384/906 |

*Primary Examiner*—Edward K. Look
*Assistant Examiner*—Michael S. Lee
*Attorney, Agent, or Firm*—Nixon & Vanderhye

[57] ABSTRACT

A high pressure multi-stage centrifugal pump with an axially split casing (10) and a number of impellers (14) carried by a drive shaft (12) has inter-stage bushings (24) and rings (22) for sealing each side of each impeller. Each bushing (24) or ring (22) is conventionally prevented from rotating by a radial pin protruding from the lower half of the casing (10) into an axial slot in the periphery of the bushing or ring. The pin is necessarily small and is liable to shear, difficult to engage in the slot and, in cases where the bushing (24) or ring (22) is diametrically split, does not allow rotation of the lower half for its removal without lifting the shaft (12). To avoid all these disadvantages, without introducing any risk of leakage, a tangential pin (32) is fitted in a blind hole (34) in the casing (10) so that its exposed end (37) is flush with the joint face (28) of the casing and abuts against a shoulder (44) formed by a recess (38) in the periphery of the bushing (24) or ring (22). This tangential pin (32) can be larger than the known radial pin and is subjected to compression, not shear.

4 Claims, 4 Drawing Sheets

HIGH PRESSURE MULTI-STAGE CENTRIFUGAL PUMPS

This case is a continuation in part of Ser. No. 07/721,384. Jun. 26, 1991, now abandoned.

BACKGROUND TO THE INVENTION

This invention relates to high pressure multi-stage centrifugal pumps used extensively though not exclusively for handling large volumes of often hazardous fluids in oil wells and the like where it is critical for safety, health, environmental and other reasons to minimise the risk of leakage. More particularly, the invention relates to means for preventing rotation of an inter-stage bushing or ring in a high pressure multi-stage centrifugal pump with an axially split casing which houses a shaft carrying impellers.

DESCRIPTION OF THE PRIOR ART

A high pressure multi-stage centrifugal pump has a number of inter-stage bushings and rings, sometimes called stage pieces and wear rings, which fit within the casing and have to be accurately positioned radially and locked against axial and rotational movement. These bushings and rings have essentially the same function as one another, namely to seal each side of each impeller, but the bushings have a larger radial thickness and may carry integral guide vanes for the incoming fluid whereas the rings have a smaller radial thickness and lack guide vanes. Radial positioning is by means of a close fit between the periphery of the bushing or ring and a bore machined in the casing. Axial location is by means of a flange on the bushing or ring which engages in an annular groove machined in the casing.

Hitherto, each bushing or ring has been prevented from rotating by means of a small pin fitted into a radial hole drilled in the base of the annular groove, said pin protruding into an axial slot machined in the flange. The pins have been fitted in the lower half of the casing in the vertical plane containing the pump axis, so that the axial slots in the bushings and rings could be engaged with the pins during the assembly of the shaft and impellers into the lower half of the casing. This arrangement has the disadvantages that the pin is necessarily small and is liable to shear if large or cyclic loads are applied to it during operation of the pump; it can be difficult to ensure correct engagement of the pin in the axial slot during assembly; and, in cases where the bushing or ring has been diametrically split to permit its easy removal, the pin does not allow rotation of the lower half to enable it to be removed without lifting the shaft.

OBJECT OF THE INVENTION

The object of the present invention is to avoid the aforesaid disadvantages without introducing any risk of leakage of pressurized fluid from the pump.

SUMMARY OF THE INVENTION

According to the invention, means for preventing rotation of an axially-fixed inter-stage bushing or ring in a high pressure multi-stage centrifugal pump with an axially split casing which houses a shaft carrying impellers comprise a tangential pin means fitted into a hole provided in either half of the casing at its joint face, which hole does not extend to the exterior of the casing in order to prevent leakage of pressurized fluid pumped by said high pressure multi-stage centrifugal pump, the center-line of the pin means being normal to the joint face and the exposed end of the pin means being flush with said face; and a recess in which the pin means engages provided in the periphery of the bushing or ring.

Other objects and advantages of the invention will become apparent from the following description of an embodiment of the invention, given by way of example:

DESCRIPTION OF THE PREFERRED EMBODIMENT

Figure 1:
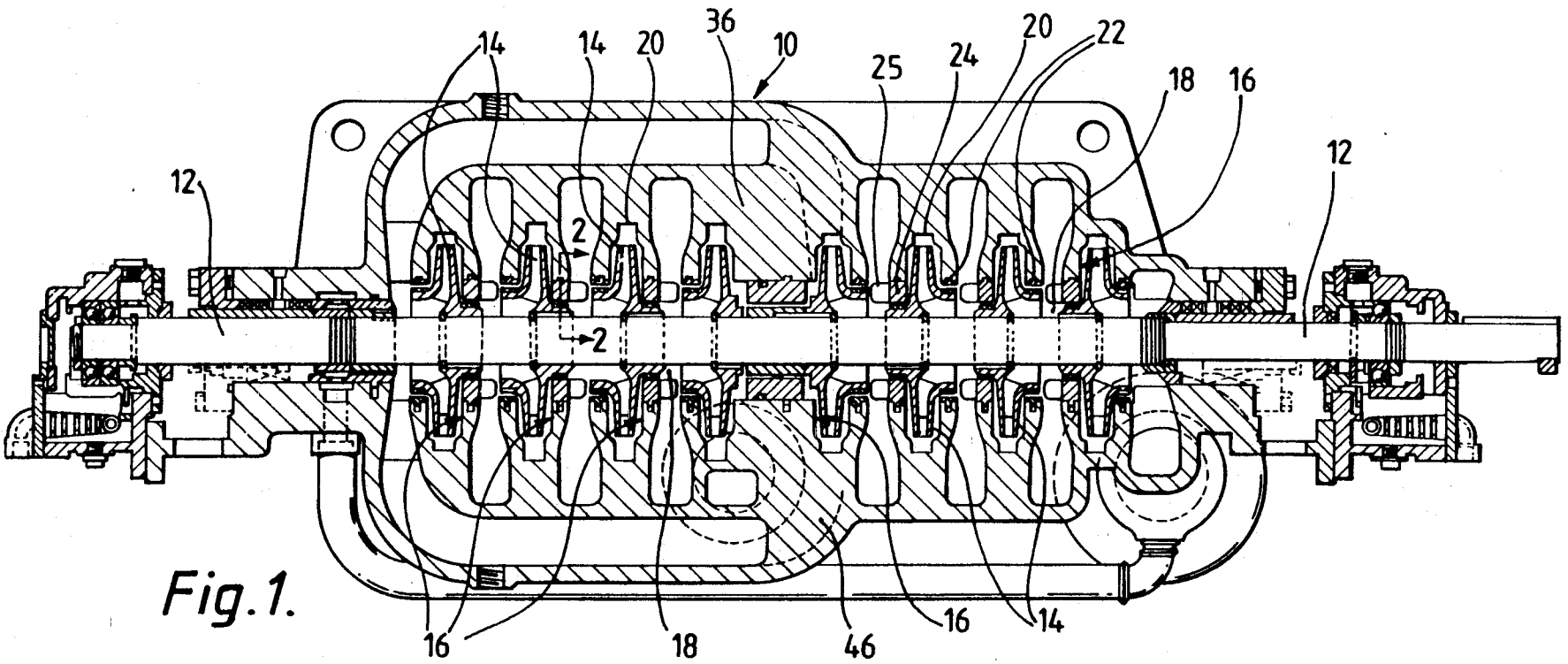
FIG. 1 is a sectional side elevation of a high pressure multi-stage centrifugal pump with a casing which is split axially in a horizontal plane.
Figure 2:
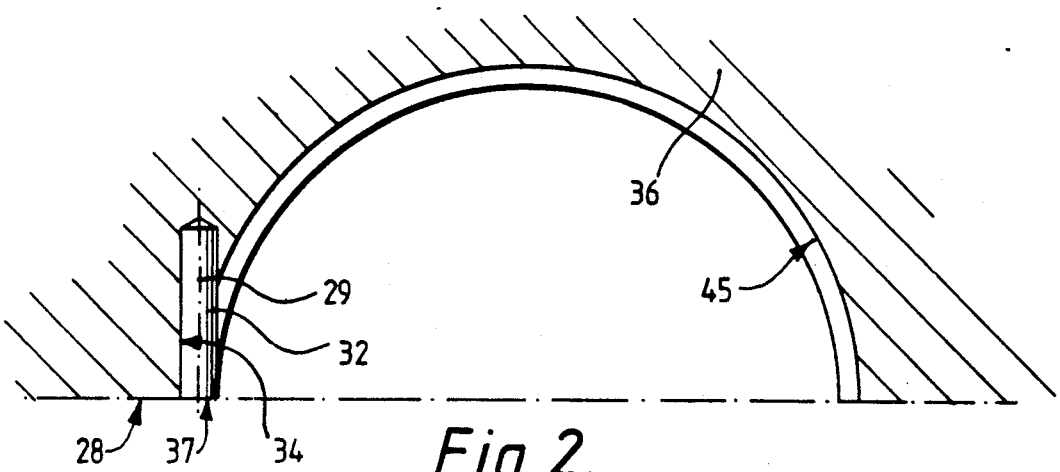
FIG. 2 is a cross-section through the upper half of the casing on the line 2—2 in FIG. 1.
Figure 3:
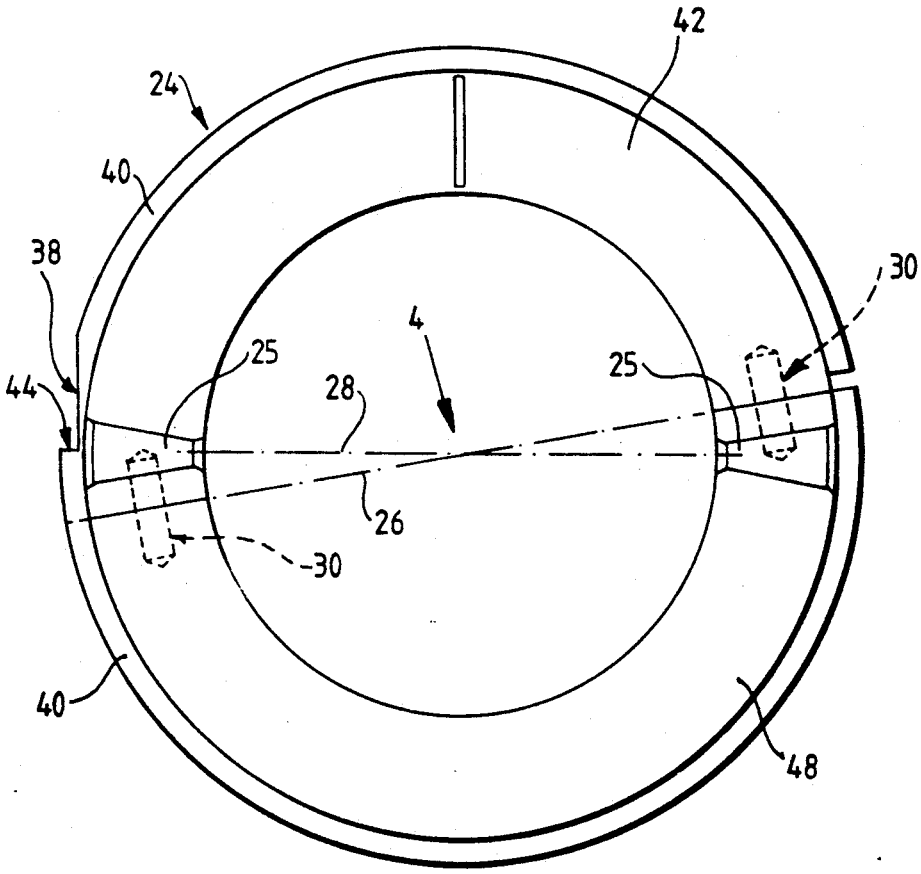
FIG. 3 is an end view of a diametrically split inter-stage bushing.
Figure 4:
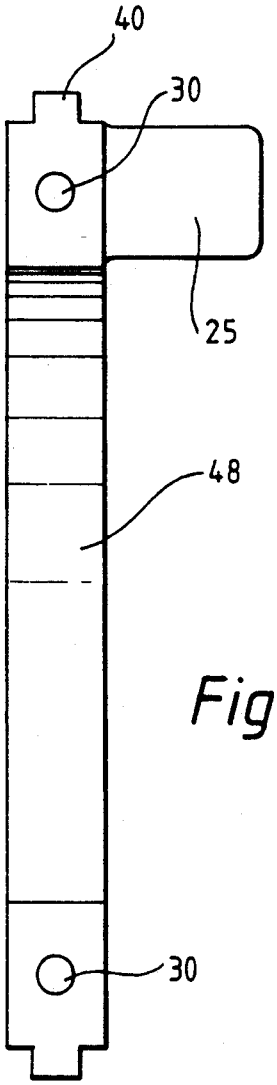
FIG. 4 is a view of one half of the bushing in the direction of the arrow 4 in FIG. 3.

Referring now to FIGS. 1 to 4 of the drawings, a preferred embodiment of the invention relates to a high pressure multi-stage centrifugal pump designed for handling large volumes of often hazardous fluids in oil wells, and the like where it is critical for safety, health, environmental and other reasons to minimize the risk of leakage. Said pump has a casing indicated generally at 10 which is split axially in a horizontal plane and houses a power-driven shaft 12 on which there are rigidly secured a plurality of impellers 14. Each impeller 14 is disposed in a chamber 16 having an axial inlet 18 and a radial outlet 20, the chambers 16 being connected in series in well-known manner. An multi-stage ring 22 is disposed at the inlet side of each impeller 14, and an multi-stage bushing 24 carrying integral guide means 25 for the incoming fluid is disposed at the other side thereof. As exemplified in FIGS. 3 and 4, each bushing 24 and ring 22 is diametrically split in a plane 26 incline at, say 10° to the horizontal, the split being below the joint face 28 of the casing 10 at that side of the casing 10 where the periphery of the rotating shaft 12 moves upwardly. The two halves of each busing 24 (and ring 22) are located together by dowels 30. Each bushing 24 (and ring 22) is prevented from rotating by a tangential pin 32 (see FIG. 2) driven into a hole 34 machined in the upper half 36 of the casing 10 at its joint face 28, the center-line 29 of the pin 32 being normal to the joint face 28 and the exposed end 37 of the pin 32 being flush with the joint face 28. The pin 32 engages in a recess 38 machined in a flange 40 on the upper half 42 of the bushing 24 (or ring 22) the recess 38 including a shoulder 44 against which the exposed end 37 of the pin 32 abuts. The flange 40 engages in known manner in an annular groove 45 machined in the casing 10. In practice, due to manufacturing tolerances, the exposed end 37 of the pin 32 may be slightly short of the joint face 28 of the casing 10 without departing from the scope of the invention, but is must not protrude beyond said face. The pin 32 is positioned at that side of the casing 10 which places said pin under compression if the bushing 24 (or ring 22) tends to rotate in the same direction as the shaft 12. The hole 34 is blind, that is to say does not extend to the exterior of the upper half 36 of the cashing 10, and thus does not breach the integrity of the assembled casing, in order positively to prevent leakage through said hole of pressurized liquid pumped by the high pressure multi-stage centrifugal pump.

Figure 6:
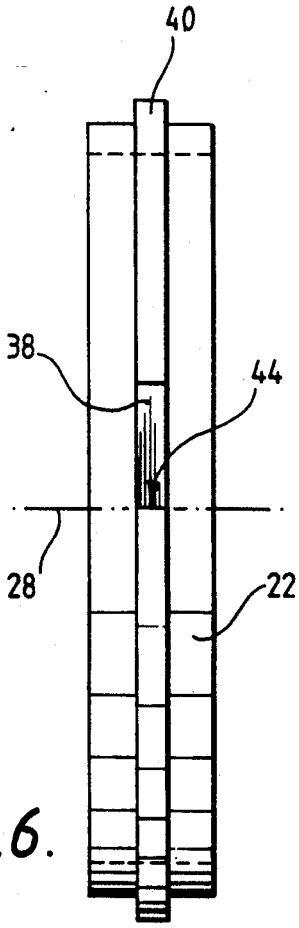
FIG. 6 is a side elevation of the ring shown in FIG. 5.
Figure 5:
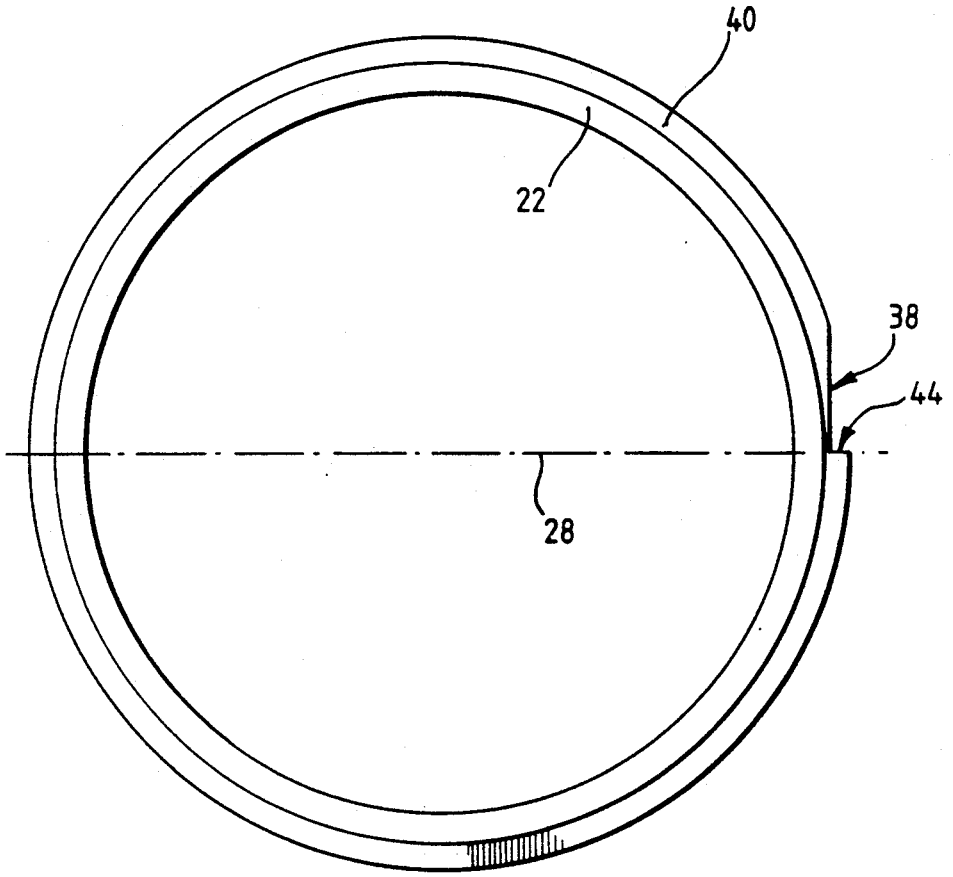
FIG. 5 is an end view of an inter-stage ring which is not diametrically split.

In a modification exemplified by the ring 22 shown in FIGS. 5 and 6, the bushings 24 and rings 22 are not diametrically split, in which case the tangential pins 32 can equally well be fitted in respective blind holes 34 formed in the lower half 46 of the casing 10.

In another modification, the recess 38 is machined in a suitable part of the periphery of the bushing 24 (or ring 22) other than the axial location flange 40 thereon.

Arrangements in accordance with the invention have the advantages that the tangential pin 32 can be much larger than the radial pin used hitherto and is in compression, not shear, so that it will readily withstand all anticipated loadings; there is a greater certainty of correct engagement of the pin 32 in the recess 38, and if engagement is not achieved further assembly of the pump is prevented; in cases where the bushing 24 (or ring 22) is diametrically split and the pin 32 is fitted in the upper half 36 of the casing 10, the lower half 48 of the bushing 24 or ring 22 can be rotated to enable it to be removed without lifting the shaft; and the blind hole 34 in which the tangential pin 32 is fitted does not introduce any risk whatsoever of leakage of pressurized fluid from the pump.

The reader's attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

I claim:

1. Means for preventing rotation of an axial-fixed multi-stage bushing or ring in a high pressure multi-stage centrifugal pump with an axially split casing which housing a shaft carrying impellers; comprising:

a tangential pin means fitted into a hole provided in either half of the casing at its joint face, which hole does not extend to the exterior of the casing in order to prevent leakage of pressurized fluid pumped by said high pressure multi-stage centrifugal pump, the center-line of the pin means being normal to the joint face and the exposed end of the pin means being flush with said face; and a recess in which the pin means engages provided in the periphery of the bushing or ring.

2. Means according to claim 1, in which the pin means is positioned at that side of the casing which places is under compression if the bushing or ring tends to rotate in the same direction as the shaft.

3. Means according to claim 1, in which the recess is machined in a flange of the bushing or ring which, by engagement in an annular groove in the casing, hold the bushing or ring axially fixed.

4. Means according to claim 1, in which the casing is split in a horizontal plane, the bushing or ring is split in a different plane, and the pin means is fitted in a hole machined in the upper half of the casing.

* * * * *